US006571499B1

(12) United States Patent
Dikov et al.

(10) Patent No.: US 6,571,499 B1
(45) Date of Patent: Jun. 3, 2003

(54) PISTOL

(75) Inventors: Diko Georgiev Dikov, Stara Zagora (BG); Stephen Ivanov Peycheff, Lynnwood, WA (US)

(73) Assignee: Revolt 2000 Ltd., Sofia (BG)

( * ) Notice: Subject to any disclaimer, the term of this patent is extended or adjusted under 35 U.S.C. 154(b) by 0 days.

(21) Appl. No.: 09/762,345

(22) PCT Filed: Mar. 19, 1999

(86) PCT No.: PCT/BG99/00003

§ 371 (c)(1),
(2), (4) Date: Apr. 16, 2001

(87) PCT Pub. No.: WO00/08407

PCT Pub. Date: Feb. 17, 2000

(30) Foreign Application Priority Data

Aug. 5, 1998 (BG) ..... 102671

(51) Int. Cl.[7] ..... F41A 9/61
(52) U.S. Cl. ..... 42/11; 42/15
(58) Field of Search ..... 42/11, 15, 39.5, 42/7; 89/195, 33.03

(56) References Cited

U.S. PATENT DOCUMENTS 597,588 A * 1/1898 Nygren
4,109,559 A * 8/1978 Davis ..... 42/71.02
5,299,373 A * 4/1994 Breiner ..... 42/15
5,784,821 A 7/1998 Gerard
5,937,558 A * 8/1999 Gerard ..... 42/15

FOREIGN PATENT DOCUMENTS

FR 550415 4/1922

* cited by examiner

*Primary Examiner*—Michael J. Carone
*Assistant Examiner*—M. Thomson
(74) *Attorney, Agent, or Firm*—Snell & Wilmer, LLP

(57) ABSTRACT

The invention refers to a Pistol that upon fire does not deviate from the sighting lie in vertical direction, that will be applied as a means of self-protection, as a hand-held fire weapon for sports, military and hunting fire. The Pistol has a casing and a barrel T-shape-connected situated into the grip made of heat-insulating polymer. The upper part of the casing and the front end of the barrel are connected by means of a clamp which is an integral one, provided with a trigger mounted on it, situated above the bore line of the barrel within the zone between the front and rear muzzle ends.

4 Claims, 4 Drawing Sheets

A-A

Figure 1:
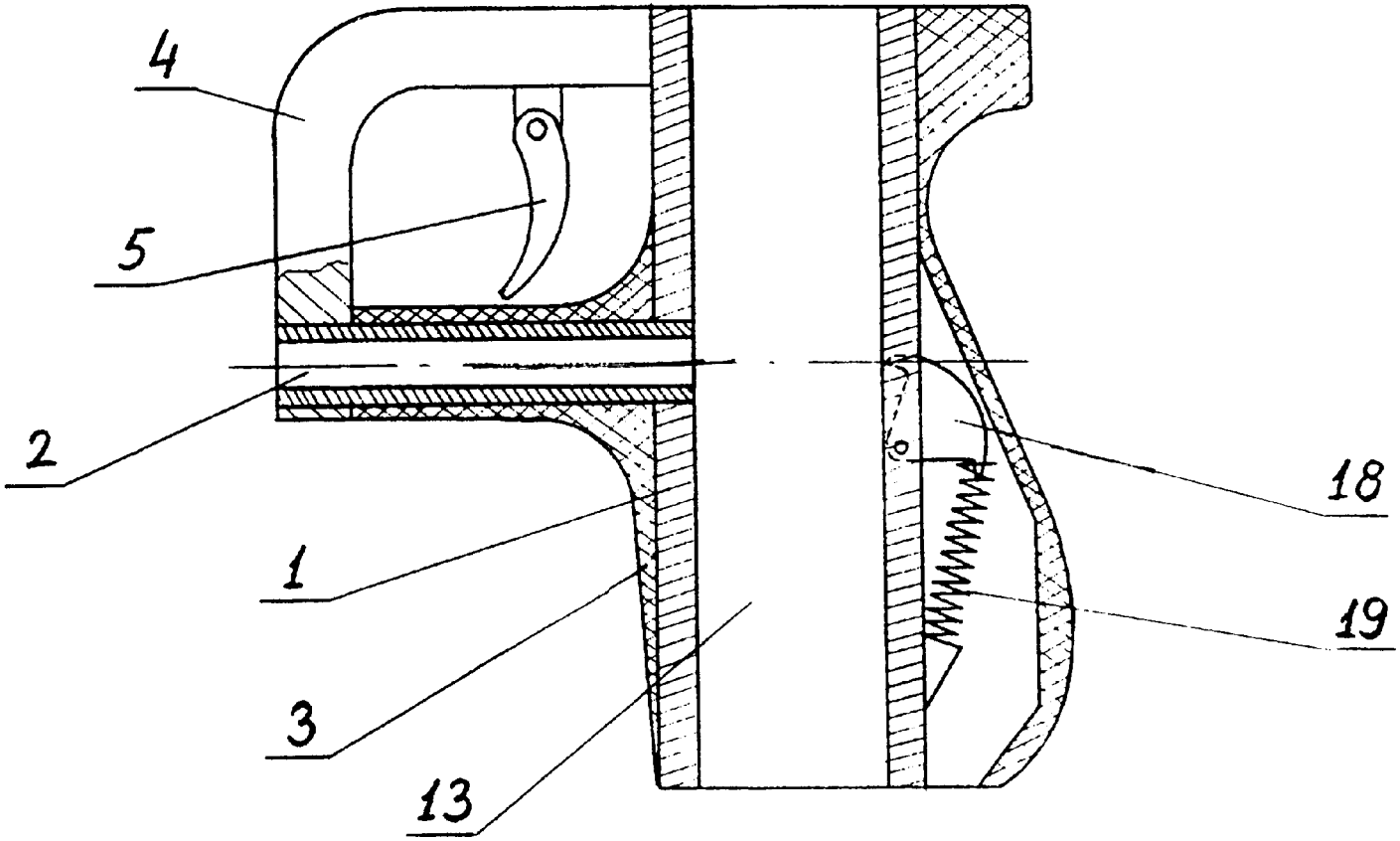

A
A
35
30
43
42
33
42
30
33
44
44
18
31
34
32
36
18
31
37
38
8
27
28
41
29
10
24
19
67
36
40
46
45
39
4
13
14
30
43
25
1
5
2

PISTOL

TECHNICAL FIELD

The invention refers that when firing does not deviate from the sight line in vertical direction, that shall be applied, either as a means of self-defense, or as a hand-held fire weapon for sports, military and hunting firing,

PRIOR ART

When firing with pistols—representatives of the well-known systems of hand-held smallarms, it is found shifting of the barrel "upwards", because of the following:

When firing with pistols from the well-known systems, there are reaction forces created (the so-called recoil), directed "backwards" along the bore line of the weapon, as these forces create a torque round the weapon support point and as a result the front end of the barrel jumps "upwards". The reason causing the motion is the disposition of the bore line above the place of weapon retaining, i. e. above the support point.

This effect is obtained when firing with pistols, one-charge and many-charge non-automatic hand-held weapons and is the reason for their basic disadvantage—the low rate of fire accuracy. (1)/"Reference Book of Smallarms", A. B. Zhuk/

At automatic self-loading weapons, the deviation from the sight line, when firing, is accelerated due to the motion of bolt parts, as the change in location of weight centres of elements of the weapon at high speeds creates inertia forces and moments additionally that aggravate accuracy.

In order to overcome the action of inertia forces during fire at this type of weapons, extra measures are taken as: corrections in sighting devices; mounting muzzle compensators, balances and retarders of fire rate; introducing disconnectors and buffers.

A disadvantage of automatic pistols is the complicated design that leads to difficulties in their handling. (2)/ "Reference Book of Smallarms", A. B. Zhuk/

There are pistols known where the barrel axis is guided to the weapon support point (the firer's palm) and it is avoided bouncing the pistol "upwards". (3)/U.S. Pat. No. 4 268 987 and pistols "Tourbean" 1883 and "Protector" 1882/ "Reference Book of Smallarms", A. B. Zhuk//

Disadvantages of these pistols are: the complicated design that hampers usage, reloading, reduces reliability, requires special ammunition; bad ergonomics and low effectiveness of firing.

It is known a sports pistol of T-shaped location of grip and barrel, consisting of a casing provided with a grip, a barrel, a trigger located above the barrel within the zone between the muzzle rear end and the grip, a bolt, a striker, a fire spring and a magazine. (4)/History of Tula Military Plant/

Disadvantages of this pistol are the risen overalls and its complex design that make its handling difficult The famous sports pistol can not be regarded as an analogue of the present invention, as it is provided with special devices ensuring improved aiming fire that complicates its design and makes it importable.

It is known a pistol consisting of a casing, a barrel, a trigger, a striker, a fire spring and a magazine, the casing and the barrel being located in a heat-insulating grip and forming a T-shape connection by means of a dismountable multi-element clamp provided with a trigger mounted on it and situated above the bore line of the barrel within the zone between the front and the rear muzzle ends connected with the feeding mechanism consisting of a feeding lever, a feeding pawl being fixed on its opposite end by means of a trigger mechanism consisting of a transfer bar geared into a striker lever provided with a cog so that the casing is provided with an inner bore of rectangular cross-section and set inside it a magazine provided with a cartridge nests set in a row and saw-like cogs set along the height of the side neighbour walls just before the rear wall of the magazine and fixing grooves located along the axes direction of cartridge nests so that the number of saw-like cogs situated on each of the neighbour walls of the magazine corresponds to the number of cartridge nests, the casing being closed from above and a striker, a fire-spring, an upper stop and a lower stop being fastened to its rear wall and a profile opening. (5))/FR-A-550 415/

The disadvantages of this pistol are the complicated design which includes a multi-element clamp connecting the barrel with casing upper end, the indirect connection between the trigger and the feeding mechanism by means of the trigger mechanism the result being a difficult use and reloading, a decreased reliability and a low fire efficiency. The ergonomics and the heat insulation of the grip are not reliable enough witch determine the insufficient fire accuracy.

The goal of this invention is to be created a portable pistol for self-protection of T-shaped disposition of the barrel and the casing, reduced weight and overalls of the weapon, high accuracy of fire and convenient handling.

TECHNICAL DESCRIPTION

The essence of the invention is the design of a Pistol that consists of a casing, a barrel, a trigger, a striker, a fire spring and a magazine, the casing and the barrel being located in a heat-insulating grip and forming a T-shape connection by means of a dismountable multi-element clamp provided with a trigger mounted on it and situated above the bore line of the barrel within the zone between the front and the rear muzzle ends. The trigger connected with the feeding mechanism consisting of a feeding lever, a feeding pawl is fixed on its opposite end by means of a trigger mechanism consisting of a transfer bar geared into a striker lever provided with a cog. The casing is provided with an inner bore of rectangular cross-section and set inside it. The magazine is provided with cartridge nests set in a row and saw-like cogs set along the height of the side neighbour walls just before the rear wall of the magazine and fixing grooves located along the axes direction of cartridge nests so that the number of saw-like cogs situated on each of the neighbour walls of the magazine corresponds to the number of cartridge nests. The casing is closed from above and a striker, a fire-spring, an upper stop and a lower stop are fastened to its rear wall and a profile opening. The clamp is an integral one and connects the upper part of the casing with the front end of the barrel. The trigger is connected with both the trigger mechanism and the feeding mechanism. The fixing grooves of the magazine are located along the axes direction of the cartridge nests between the highest and the lowest points along the height of the saw-like cogs. The striker is a metallic circular sector with a fire pin in one of arc ends with an opening in the centre of the circle situated below the bore line . The point of the fire pin coincides with the bore line. The fire spring is connected with the arc end opposite the fire pin, the upper stop having the form of a reverse "Y" provided with a short arm and a long arm and is situated above the bore line,. The lower stop being situated below the striker pin so that its lower under-spring end is below the level of the grip.

As a second variant of the invention a Pistol consists of a casing, a barrel, a trigger, a striker, a fire spring and a magazine, the casing and the barrel being located in a heat-insulating grip and forming a T-shape connection by means of a dismountable multi-element clamp provided with a trigger mounted on it and situated above the bore line of the barrel within the zone between the front and the rear muzzle ends. The trigger is connected with the trigger mechanism consisting of a transfer bar geared into a striker lever provided with a cog. The casing is provided with an inner bore of rectangular cross-section and set inside it. The magazine is provided with cartridge nests set in a row and saw-like cogs set along the height of the side neighbour walls just before the rear wall of the magazine and fixing grooves are located along the axes direction of cartridge nests so that the number of saw-like cogs situated on each of the neighbour walls of the magazine corresponds to the number of cartridge nests. The casing is closed from above a striker, a fire spring are fastened to its rear wall and a profile opening is shaped into its side wall. The magazine is provided with a lock pin and the casing is closed from above and below and provided with a hinge-fastened cap with a built-in upper stop, a lower stop, a latch of T-shape provided with a grip, a striker and a fire spring. A rectangular opening is shaped in the casing rear wall under the bore line at the lower base. A horizontal fixing slot is shaped in the casing rear wall above the bore line. A longitudinal guiding groove, along the height with a feeding spring set in it, and a vertical slot, beginning from the bore line and ending in the lower base, are shaped in the opposite side wall of the casing. The cap is provided with an arm with an elevating arm hinge-fixed to it with an elevating cog shaped at the end and an inner edge-ejector shaped at the end of one of its walls. A fixing mechanism, consisting of a lever-cradle and a fixing arm provided with a fixing cog, is connected to the trigger.

The third variant of the invention is a Pistol that consists of a casing, a barrel, a trigger, a striker, a fire spring and a magazine, the casing and the barrel being located in a heat-insulating grip and forming a T-shape connection by means of a dismountable multi-element clamp provided with a trigger mounted on it and situated above the bore line of the barrel within the zone between the front and the rear muzzle ends. The trigger is connected with the trigger mechanism consisting of a transfer bar geared into a striker lever provided with a cog. The casing is provided with an inner bore of rectangular cross-section and set inside it. the casing being provided with an inner bore of rectangular cross-section and set inside it a magazine and closed from above, a striker and a fire spring fixed onto its rear wall. The casing is a rectangular prism provided with an inner bore of rectangular cross section having a magazine-metallic box provided with a pushing spring and a closing cover situated in it. The spiral recoil spring is thrust onto the barrel thickened in a step-like way at the rear end with a cartridge chamber shaped into the thickened part and along its outer surface guiding grooves longitudinally slant towards the bore line and close to the rear cut of the transverse groove.

To the casing it is movably fastened a cover fixed to a pin provided with a grip, a cradle provided with a guiding pawl, a deflector with a lower end bent inside as a knocking out pawl whit an under-spring upper end, a striker, a fire spring, an S-shaped latch and an immovably fastened ejector. A guide opening with two cogs mirror-symmetrically located up and down in the front wall of the casing and an elongated slot and back slot in the side wall within the zone of the bore line.

The advantages of the Pistol according to the invention are the following:

The pistol structure subject of the present invention ensures precise and accurate fire apart from the firer's experience, because of the absence of deviation from the sighting line in vertical direction when firing with it.

The proposed design solution allows assembling an article of improved parameters in relation to weight, compactness, ergonomics, simplicity, safety and reliability when handling it, in comparison with the articles of the same designation known and used at the moment and is a new development possible because of the originality of the design solution and used materials.

The design allows easy, precise and quick fire with cartridges of various calibres and as a result the Pistol, subject of the invention, becomes an accurate, reliable, portable and cheap self-protection weapon.

The manufacture of the Pistol in conformity with the invention allows to achieve a high economic effectiveness by making the structure lighter and reducing the complexity and the difficult technological manufacture of different elements and units.

DESCRIPTION OF THE FIGURES ENCLOSED

Examples of pistol performances through which the essence of the invention and the principle of operation is explained, are shown on the enclosed figures.

Figures 2, 3:
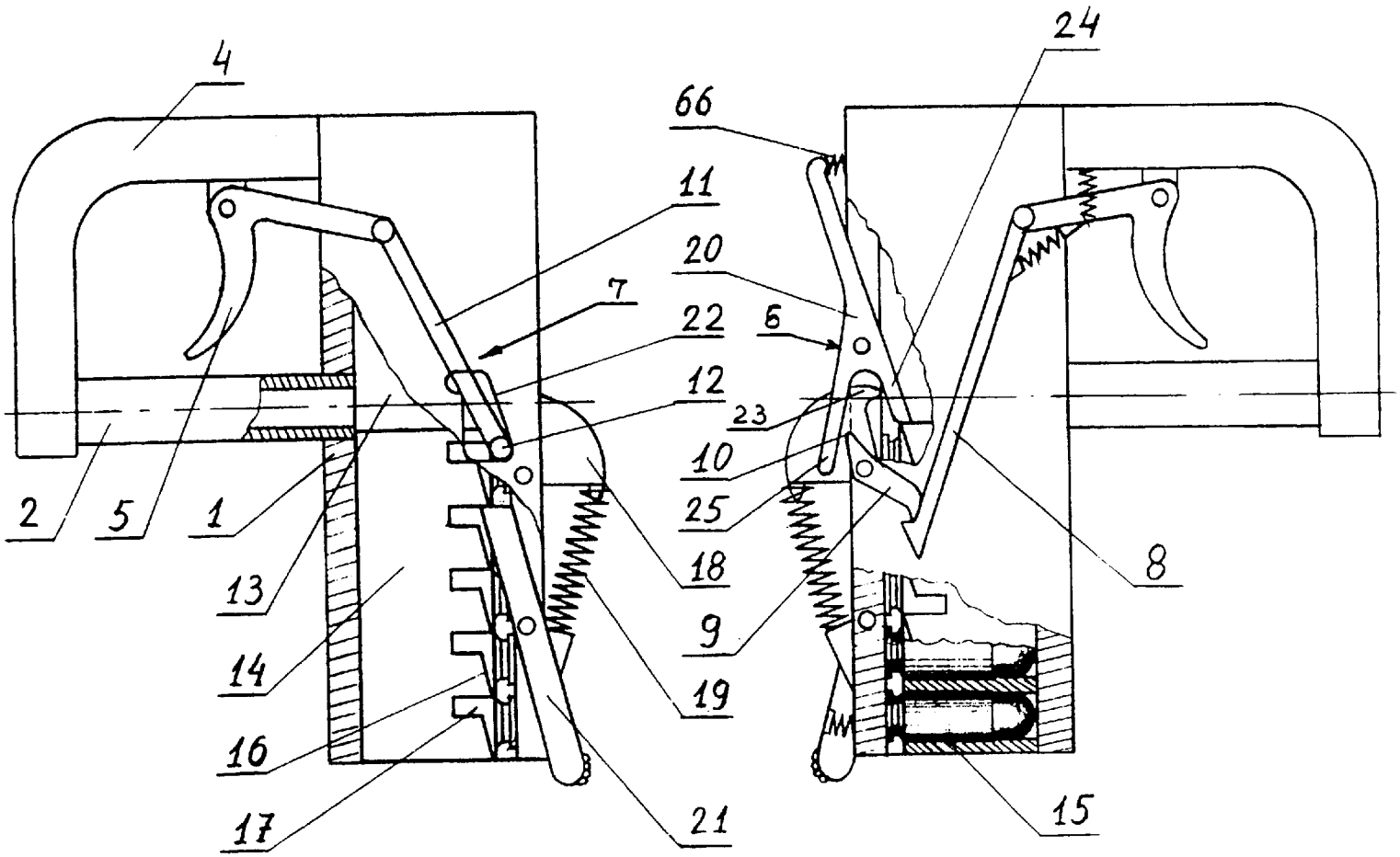
Figures 4, 5, 6:
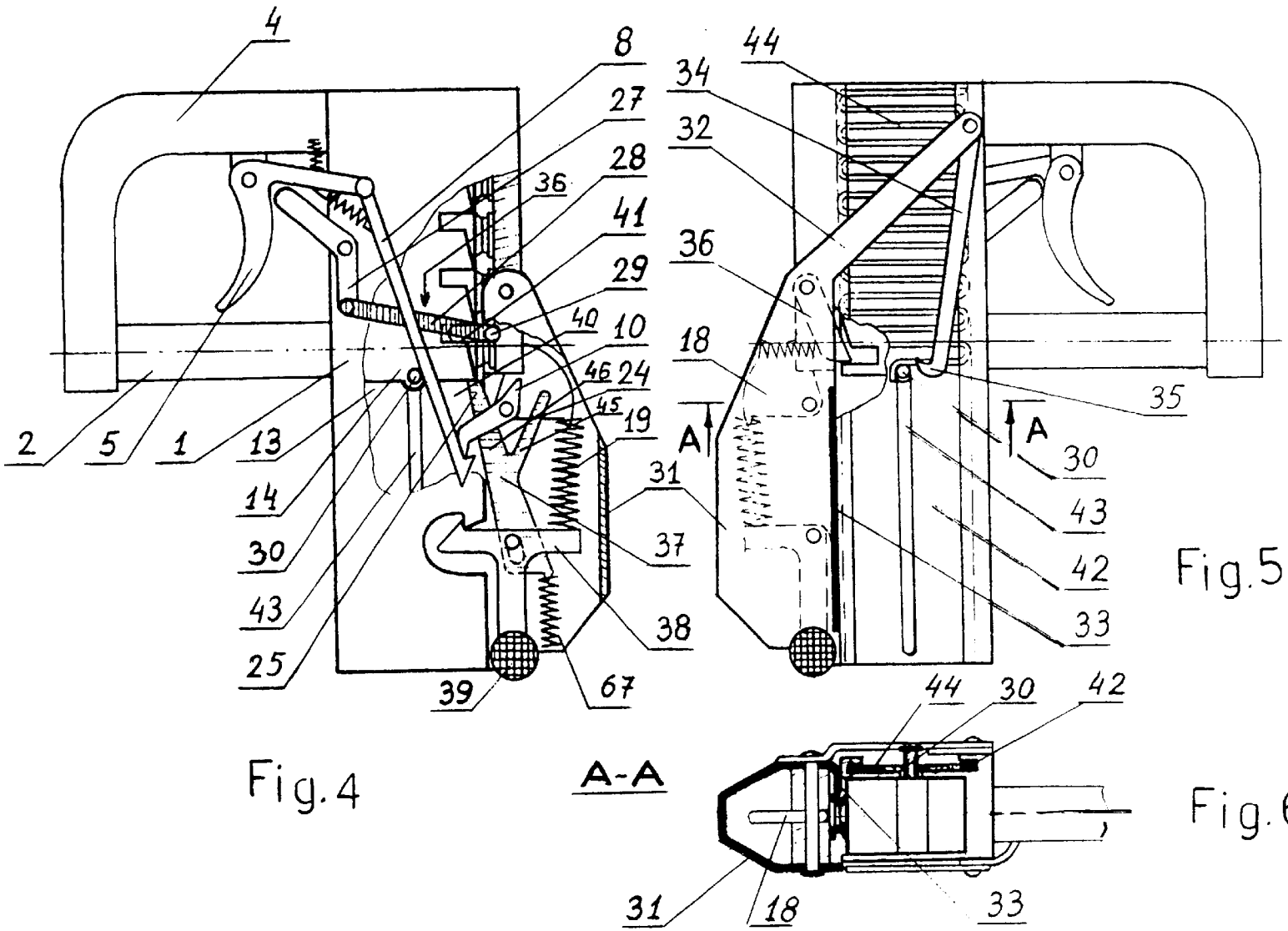
Figure 8:
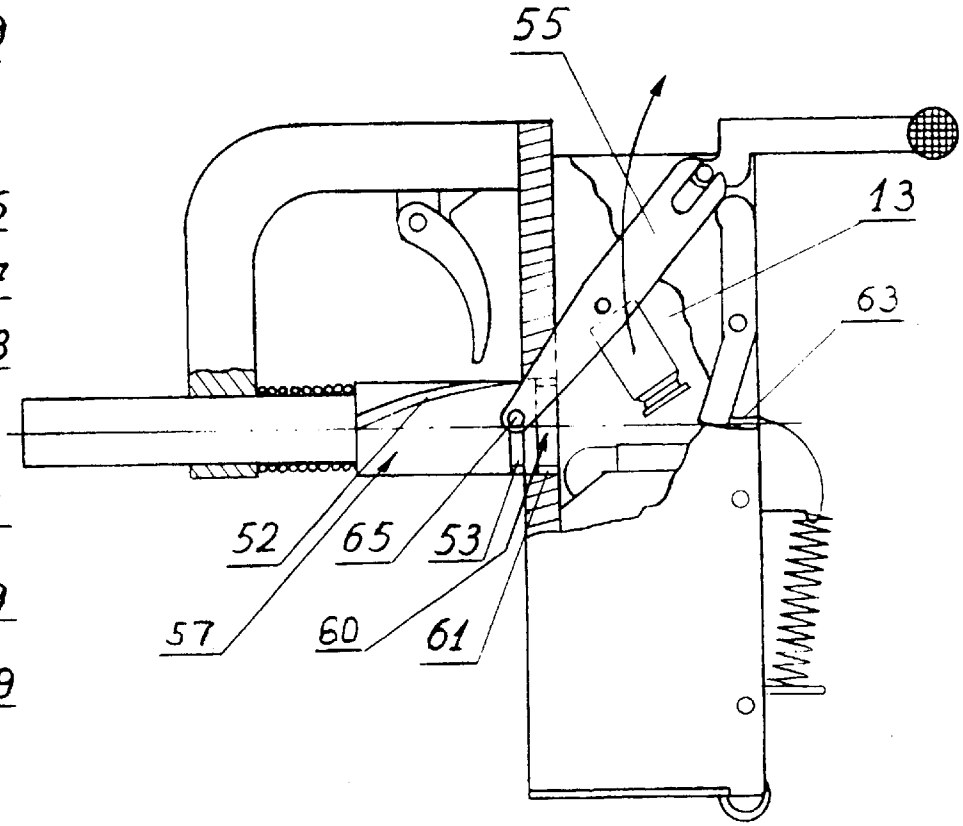
Figure 7:
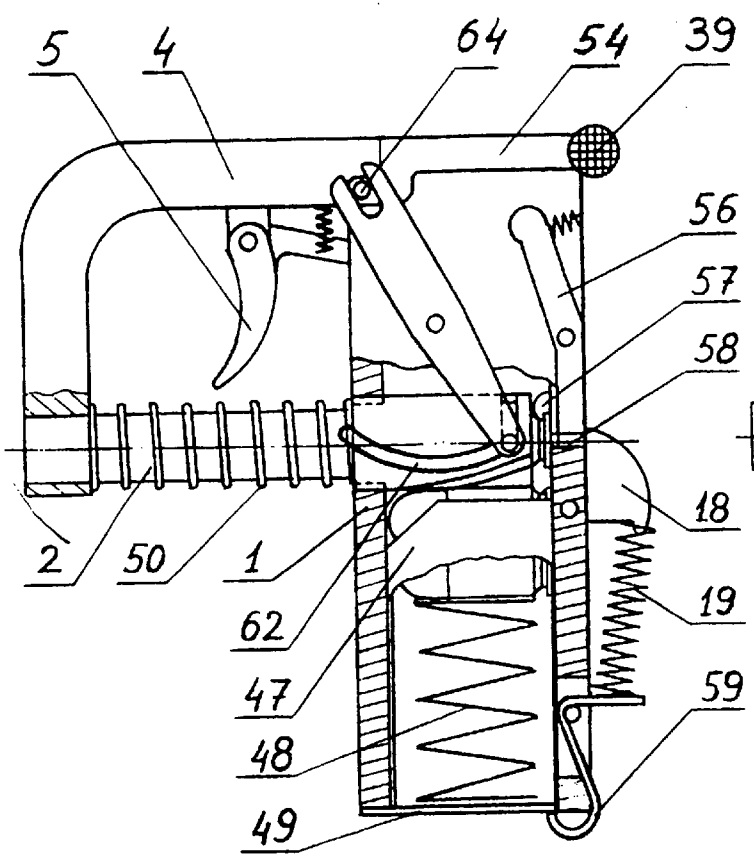

FIG. 1—schematic diagram of basic elements of the invention;

FIG. 2—left-side view of a variant with mechanical step feeding of the magazine by means of a trigger (revolver type);

FIG. 3—right-side view of a variant with mechanical step feeding of the magazine by means of a trigger (revolver type);

FIG. 4—left-side view of a variant with mechanical step feeding of the magazine by means of a spring;

FIG. 5—right-side view of a variant with mechanical step feeding of the magazine by means of a trigger (revolver type);

FIG. 6—section along A—A of a right-side view of a variant with mechanical step feeding of the magazine by means of a spring;

FIG. 7—left-side view of a variant with automatic reloading (before shooting);

FIG. 8—left-side view of a variant of automatic reloading (during shooting).

EXAMPLES OF EXECUTION

The following examples would explain the invention:

Example 1

A Pistol where the casing 1 and the barrel 2 form an immovable T-shaped connection and are situated in the grip 3 made of heat-insulating material. The upper part of the casing 1 and the front end of the barrel 2 are connected by means of a clamp 4 provided with a trigger 5 mounted on it situated above the bore line of the barrel 2 within the zone between the front and rear muzzle ends. The trigger 5 is connected simultaneously with a trigger mechanism 6 and a feeding mechanism 7. The trigger mechanism 6 consists of a transfer bar8 geared into the striker lever 9 provided with a cog 10. The feeding mechanism 7 consists of a feeding lever 11 with a feeding pawl 12 fixed at its opposite end. The casing 1 is a rectangular prism provided with an inner bore13 of rectangular cross section. In the inner bore 13 there is a magazine 14 set. The magazine 14 is shaped as a rectangular metallic prism provided with more than 4 cartridge nests 15, situated in a row and a saw-like cogs 16, situated along the height of the side neighbour walls just before the rear wall of the magazine 14 and provided with fixing grooves 17. The fixing grooves 17 are situated along the axes of the cartridge nests 15 between the highest and lowest point along the height of the saw-like cogs 16. Number of the saw-like cogs 16 situated on each of the neighbour walls of the magazine 14 corresponds to the number of the cartridge nests 15.

The casing 1 is closed from above and at its rear part there are a striker 18, a fire spring 19, an upper stop 20 and a lower stop 21 fixed to its rear wall. A profile opening 22 is shaped into the side wall of the casing 1.

The striker 18 is a metallic circular sector with a fire pin 23 shaped in one of arc ends with an opening in the centre situated below the bore line, so that the point of the fire pin coincides with the bore line. The fire spring 19 is connected to the arc end opposite to the fire pin 23. The upper stop 20 has the form of a reverse Y provided with a short arm 24 and a long arm 25 and is situated above the bore line. The lower stop 21 is situated below the striker pin, so that the lower under-spring end is below the level of the grip 3/FIG. 1, FIG. 2 & FIG. 3/.

Example 2

The Pistol where the casing 1 and the barrel 2 form an immovable T-shaped connection and are situated in the grip 3 made of heat-insulating polymer. The upper part of the casing 1 and the front end of the barrel 2 are connected by means of a clamp 4 provided with a trigger 5 mounted on it situated above the bore line of the barrel 2 within the zone between the front and rear muzzle ends. The trigger 5 is connected simultaneously with a trigger mechanism 6 and a fixing mechanism 26. The trigger mechanism 6 consists of a transfer bar8 geared into the striker lever 9 provided with a cog 10. The fixing mechanism 26 consists of a lever-cradle 27 and a fixing pawl 28 provided with a fixing cog 29. The casing 1 is a rectangular prism provided with an inner bore 13 of rectangular cross section. In the inner bore 13 there is a magazine 14 set. The magazine 14 is shaped as a rectangular metallic prism provided with more than 4 cartridge nests 15, situated in a row, saw-like cogs 16 and a lock pin 30. The saw-like cogs 16 situated along the height of the side neighbour walls just before the rear wall of the magazine 14 and provided with fixing grooves 17. The fixing grooves 17 are situated along the axes of the cartridge nests 15 between the highest and lowest point along the height of the saw-like cogs 16. Number of the saw-like cogs 16 situated on each of the neighbour walls of the magazine 14 corresponds to the number of the cartridge nests 15.

The casing 1 is closed from above and down with the cap 31 hinge connected. The cap 31 is provided with an arm 32 having an inner edge shaped at the end of one of its walls—ejector 33 within the zone under the bore line. An elevating arm 34 with an elevating cog shaped at its end forms a hinge-connection with the arm 32 of the cap 31.

An upper stop 36, a lower stop 37, a latch 38 of T-shape provided with a grip 39, a striker 18 and a fire spring 19 are built into the cap 31. A rectangular opening 40 is shaped in the rear wall of the casing 1 within the zone from the bore line to the lower base. A horizontal fixing slot 41 is shaped in the side wall of the casing 1 above the bore line and a longitudinal groove 42 and a vertical slot 43, beginning with the bore line and ending in the lower base zone, are shaped in the opposite side wall of the casing 1 along the height. In the longitudinal guiding groove 42 along the height it is located a feeding spring 44 limited from the bottom by a pin 30. The feeding spring 44 is a flat-crooked helical spring of round cross section wire. The striker 18 is a metallic round sector with a fire pin shaped at on of arc ends with an opening in the circle centre, located under the bore line. The fire spring 19 is connected as to the opposite end of the fire pin 23 of the arc of the striker 18 as to the horizontal arm of the latch 38 of T-shape. The upper stop 36 is set above the bore line and is fixed to the pivot axis of the cap 31. The lower stop 37 is of a reverse V shape, provided with a short arm 45 and a long arm 46 and is located under the striker axis./FIG. 1, FIG. 4, FIG. 5 & FIG. 6/

Example 3

The Pistol where the casing 1 and the barrel 2 form a movable T-shaped connection and are situated in the grip 3 made of heat-insulating polymer. The upper part of the casing 1 and the front end of the barrel 2 are connected by means of a clamp 4 provided with a trigger 5 mounted on it situated above the bore line of the barrel 2 within the zone between the front and rear muzzle ends. The trigger 5 is connected as with a trigger mechanism 6 as with a fixing mechanism 26. The trigger mechanism 6 consists of a transfer bar 8 geared into the striker lever 9 provided with a cog 10. The casing 1 is a rectangular prism provided with an inner bore 13 of rectangular cross section. The magazine 47 is situated in the inner bore 13. The magazine 47—metallic box—is provided with a pushing spring 48 and a closing cover 49. A spiral recoil spring 50 is thrust onto the barrel 2 and the barrel 2 is thickened at its rear in a step-like way as the rear end of the spiral recoil spring 50 contacts with the step at the rear end of the barrel 2 and, its front end contacts with the clamp 4. There is a cartridge chamber 51 formed in the thickened inner part as along its inner surface there are guiding grooves 52 slant longitudinally towards the bore line, guiding grooves, and close to the rear cut there is a cross groove 53.

A cover 54 provided with a grip 39, a cradle 55, a deflector 56 are fastened movably to the casing 1 within the zone of side walls and an ejector 57 is immovably fixed, too. The deflector 56 has a lower end bent inside as a knocking out pawl 58 with an under-spring upper end.

A striker 18, a fire spring 19 and an S-like latch are fastened movably to the casing in the zone of the rear wall. The S-like latch contacts as with the fire spring 19 at its upper end, as with the closing cover 49 of the magazine 47 at its lower part.

There is a guiding opening 60 with two cogs 61 mirror-symmetrically disposed from above and down in the front wall of the casing 1 and also an elongated arc-like slot 62 and a rear slot 63 shaped in the side wall of the casing 1 within the zone of the bore line.

The casing 1 is closed from above by means of a cover 54 with a lock pin 64 and the cradle 55 is provided with a guiding pawl 65./FIG. 7 & FIG. 8/

The beforehand examples do not bound the invention performance into other modifications.

HANDLING THE INVENTION

When using the Pistol, subject of the present invention, of design described in Example 1, cartridges are arranged in a metallic magazine with cartridge nests formed inside and the magazine is moved in a step-like down-up way behind the barrel through the action of the trigger pull./FIG. 1, & FIG. 3/

Handling is carried out in the following way:

After filling the magazine 15 with cartridges in the cartridge nests 15, it is proceeded with the pistol loading. To this end, the filled magazine 14 is inserted into the grip 3 through the lower opening of the inner bore 13 from the bottom to the top till the moment the first from the saw-like cogs 16, located along the right neighbour wall, contacts the short arm 24 of the V-shape upper stop 20. At the same time the lower stop 21 situated on the opposite wall locks it in this position so that the top most cartridge is set under the bore line. Through the profile opening 22 in the rear wall of the casing 1, the feeding pawl 12 is facing the saw-like cogs 16 of the magazine 14.

Pulling the trigger 5 brings simultaneously to rotating the striker 18 "backwards" round its axis set under the bore line, through the action of the transfer bar 8 that draws out the striker lever 9 upwards, the cog 10 pushes the long arm 25 of the upper stop 20 "backwards" and takes out the short arm 24 from gearing with the magazine 14.

From the other end the feeding pawl 12 starts gearing with the fixing grooves 17 of the magazine 14 and drawing it upwards sliding along the vertical edge of the profile opening 22. When the feeding pawl 12 contacts with the upper edge of the profile opening 22, it changes the motion direction into, "forward" locking the magazine 14 to the casing 1. Besides, the first cartridge has been fed against the barrel 2. At the same time the transfer bar 7 releases the striker lever 9 and through the action of the fire spring 19, the striker 18 hits the cartridge primer and takes a shot.

Through the action of the spring 66 depressing its upper end, the upper stop 20 enters over the subsequent saw-like cog 16 of the magazine 14 along with the striker 18, as its short arm 24 gears with the saw-like cogs 16 of the magazine 14 and its long arm 25 remains behind the cog 10 of the striker lever 9 and the lower stop 21 has already missed one saw-like cog 16 and is geared under the next one. Releasing the trigger 5, which is under-spring, brings to going out of the feeding pawl 12 from the fixing groove 17 of the magazine 14 and reversing in home position. The transfer bar 7 moves downward till the cog 10 gears again with the striker lever 9. So, the pistol is ready for the next shot. After firing the cartridges from the magazine 14 or upon other necessity, the lower end of the lower stop 21 is pushed forward, so that its lower under-spring end is below the level of the grip 3 and the magazine 14 goes out through the action of its own weight. Afterwards the pistol is loaded with a second filled up magazine 14 or the cases of the magazine already taken out are replaced with cartridges.

When using the pistol, subject of the present invention, of design described in Example 2, cartridges are arranged in a metallic magazine with cartridge nests formed inside in a row and the magazine is moved in a step-like up-down way behind the barrel through the action of the feeding spring folded in advance./FIG. 1, FIG. 4, FIG. 5 & FIG. 6/

Handling is carried out in the following way:

The magazine 14 is set in the inner bore 13 of the casing 1. To load the pistol, the grip 39 is withdrawn backwards, as the cap 31 is opened up to 90°, so that the upper stop 36, the lower stop 37, the latch 38 of T-shape, the striker 18 and the fire spring 19 are moved along with the cap 31 backwards and upwards, as the excess to the magazine 14 is released being in lower extreme position depressed by the feeding spring 44. The arm 32 of the cap 31 pushes downward the elevating frame 34 till the elevating cog 35 seizes the lock pin 30 situated at the lowest point of the vertical slot 43. Cartridges are set into cartridge nests 15. After loading the magazine 14, the cap 31 is closed. The elevating draws the magazine 14 upwards so that the feeding spring 44 is depressed, so when reaching an upper position, the elevating cog 35 releases the lock pin 30. At the same time the lower stop 37 has entered the zone of gearing with the lowest saw-like cogl6 of the magazine 14. Through the action of the feeding spring 44 the lower stop moves downward along its elongated opening. The upper stop 36 gears with the lowest saw-like cog 16 of the magazine 14 from its opposite side. The first cartridge has been introduced into the barrel 2 and the pistol is ready for fire.

Pulling the trigger 5 brings simultaneously to rotating the striker 18 "backwards" round its axis set under the bore line, through the action of the transfer bar 8 that draws out the striker lever 9 upwards, the cog 10 pushes the short arm 24 of the lower stop 37 "backwards" and takes out the long arm 25 from gearing with the magazine 14, so that its long arm 25 skips the top of the saw-like cog 16 and goes out of gearing with it and through the action of the spring 67, the lower stop 37 raises along its elongated opening clamping into the inter-cogs area At the same time the cradle 27 geared into the trigger 5 turns round and withdraws the fixing pawl 29 along the fixing slot 41 into the subsequent fixing groove 17 of the magazine 14.

Afterwards the transfer bar 8 releases the striker lever 9 and through the action of the fire spring 19, the striker 18 hits the cartridge primer fires a shot Releasing the trigger 5 brings to pushing the fixing pawl 29 from the current fixing groove 17 of the magazine 14. The so-released magazine 14, through the action of the feeding spring 44, goes downward and the lower stop 37 meets the next saw-like cog 16 of the magazine 14 with its long arm 25, descending along its elongated opening, depressing the spring 67, so that the next cartridge has been introduced into the barrel 2. After firing all the cartridges from the magazine, the cap 31 is unclamped by drawing the grip 39 backwards. Meanwhile, the ejector 33 has remained before the rims of cases moving downwards and when opening the cap 31, seizes and draws them from cartridge nests 15 of the magazine 14, so that the magazine 14 is ready for refilling.

The Pistol, subject of the present invention, of design described in Example 3, is a self-loading pistol and functions according to the system-long stroke of barrel forward at an immovable bolt./FIG. 7, FIG. 8/

Its handling is carried out in the following way:

After filling the magazine 47 with cartridges, it is proceeded with pistol loading. To this end the filled magazine 47 is thrust into the grip 3 through the lower opening of the inner bore 13 down-up till the moment when the closing cover 49 fixes to the casing 1 by means of the S-shaped latch 59, so that the upper cartridge is clamped to the outer surface of the barrel 2 within the thickened zone. After that the grip 39 of the cover 54 is withdrawn backwards till stoppage. By the kinematics chain, the cover 54, the cradle 55, the guiding pawl 65 and the cross groove 53, the barrel 2 is pushed forward depressing the spiral recoil spring 50. The upper cartridge is pushed upwards by the pushing spring 48 of the magazine 47 till its rim enters the ejector 57. When releasing the grip 39 of the cover 54, through the action of the spiral recoil spring 50, the barrel 2 reverses backwards and thrusts onto the fed cartridge. The cover 54 also returns back and closes from above the inner bore 13 of the casing operating as a case outlet. The pistol is ready for fire, as the first cartridge has been introduced into the barrel 2.

Pulling the trigger 5 cocks the striker 18 by means of the transfer bar 8, afterwards it releases the striker lever 9 and through the action of the fire spring 19, the striker 18 hits the cartridge primer and fires.

When firing, the bullet sets forth into the barrel and the friction forces affect it. The barrel shifts forward, as moves simultaneously linear and rotary motion round its axis and as a result of sliding the cogs 61 along the guiding grooves 52, slant longitudinally towards the bore line. Shifting forward, the barrel 2 goes out of the case scope, opens the cover 54 and folds the spiral recoil spring 50. When reaching front extreme position, the end of the cradle 55, moving backward, hits the upper end of the deflector 56, so that the pawl 58 knocks out the case from the ejector 57 and it flies upwards through the case outlet. At the same time the unoccupied place has been taken from the next cartridge, so that the barrel 2, returned back by the spiral recoil spring 50, is thrust onto it. After releasing the trigger 5, the pistol is ready for the next firing. Reloading is carried out, as the S-shaped latch 59 is pressed backward, so that the emptied magazine 14 is taken out and replaced with a newly-filled one.

What is claimed is:

1. A weapon including:

a heat-insulating grip;

a magazine having cartridge nests set in a row and saw-like cogs set along the height of side neighbor walls before a rear wall of said magazine;

a casing located in said heat-insulating grip, said casing including an inner bore of rectangular cross-section and closed from above, said magazine, fixing grooves located along axes direction of cartridge nests so that the number of saw-like cogs situated on each of said neighbor walls of said magazine corresponds to the number of said cartridge nests, and a striker, a firespring, an upper stop and a lower stop being fastened to a rear wall of said casing and a profile opening;

a barrel having a bore line and located in said heat-insulating grip, said casing and said barrel forming a T-shape connection;

a trigger mounted on said dismountable multi-element clamp and attached to a trigger mechanism including a transfer bar geared into said striker lever;

a feeding mechanism having a feeding lever and a feeding pawl being fixed on its opposite end by means of said trigger mechanism;

a dismountable multi-element clamp situated above said bore line of said barrel within a zone between a front and a rear muzzle ends and connected with said feeding mechanism;

a striker including a striker lever having a cog; and, a means for moving said magazine in a step-like way behind said barrel to minimize recoil of said weapon when firing said weapon.

2. A weapon according to claim 1 wherein said heat-insulating grip comprises a heat-insulating polymer.

3. A weapon of claim 1, wherein said means for moving said magazine includes a direct connection between said trigger and said feeding mechanism.

4. A weapon of claim 3, wherein said direct connection between said trigger and said feeding mechanism includes moving said magazine through an action of a trigger pull, wherein a clamp is integral and connects the upper part of said casing with a front end of said barrel, said trigger being connected with both said trigger mechanism and said feeding mechanism, said fixing grooves of said magazine being located along axes direction of said cartridge nests between highest and lowest points along a height of said cogs, said striker being a circular sector of a circle with a fire pin in one of arc ends with an opening in a center of said circle situated below said bore line so that a point of said fire pin coincides with said bore line and said fire spring is connected with said arc end opposite said fire pin, said upper stop in a reverse "Y" configuration provided with a short arm and a long arm and being situated above said bore line, said lower stop being situated below said striker pin so that a lower under-spring end of said lower stop is below the level of said heat-insulating grip.

* * * * *